United States Patent [19]

Lyons

[11] Patent Number: 4,678,045

[45] Date of Patent: Jul. 7, 1987

[54] TURBINE TOOL

[76] Inventor: William C. Lyons, P.O. Box 2457, Santa Fe, N. Mex. 87504-2457

[21] Appl. No.: 785,492

[22] Filed: Oct. 8, 1985

Related U.S. Application Data

[63] Continuation-in-part of Ser. No. 514,865, Jul. 18, 1983, abandoned.

[51] Int. Cl.[4] ..... E21B 4/02; E21B 7/04

[52] U.S. Cl. ..... 175/61; 175/100; 175/106; 175/107; 175/227; 415/111; 415/502

[58] Field of Search ..... 175/106, 107, 61, 73, 175/75, 100, 227-229; 415/502, 110, 111

[56] References Cited

U.S. PATENT DOCUMENTS

| | | | |
|---|---|---|---|
| 1,790,460 | 1/1931 | Capeliuschnicoff | 175/106 |
| 2,167,194 | 7/1939 | Anderson | 175/73 |
| 2,699,920 | 1/1955 | Zublin | 175/81 |
| 2,708,099 | 5/1955 | Zublin | 175/75 |
| 2,717,146 | 9/1955 | Zublin | 464/149 |
| 2,734,720 | 2/1956 | Zublin | 175/76 |
| 2,743,082 | 4/1956 | Zublin | 175/61 |
| 2,745,634 | 5/1956 | Zublin | 175/76 |
| 2,745,635 | 5/1956 | Zublin | 175/76 |
| 2,804,926 | 9/1957 | Zublin | 166/50 |
| 3,083,779 | 4/1963 | Rowley | 175/107 |
| 3,365,170 | 1/1968 | Whittle | 415/502 |
| 4,333,539 | 6/1982 | Lyons et al. | 175/61 |
| 4,432,423 | 2/1984 | Lyons et al. | 175/75 |

*Primary Examiner*—James A. Leppink
*Assistant Examiner*—Hoang C. Dang
*Attorney, Agent, or Firm*—James E. Snead

[57] ABSTRACT

A drill string is made flexible near the lower marginal end thereof, and a pneumatic turbine motor is located at the lower terminal end thereof. The pneumatic turbine is connected to a planetary gear reduction system for rotating a drill bit. The diameter and the length of the pneumatic turbine motor, gear reduction system, and bit is of a size which enables the entire assembly to negotiate a sharp bend in the borehole, so that the borehole can be formed to extend downwardly along a relatively straight vertical line towards a payzone, where the borehole then sharply bends laterally towards the payzone, and then continues in another relatively straight line horizontally through the payzone. The pneumatic turbine motor includes reaction ports arranged to force the drill bit against the formation being penetrated, and to counteract the bit torque. Part of the input gases pass through the pneumatic turbine and is exhausted through the bit while the remaining part of the input gases is exhausted through the reaction ports into the annular space, and serve as drilling fluid.

3 Claims, 12 Drawing Figures

TURBINE TOOL

REFERENCE TO RELATED PATENT APPLICATIONS

This patent application is a continuation-in-part of patent application Ser. No. 514,865 filed July 18, 1983, abandoned.

BACKGROUND OF THE INVENTION

In drilling boreholes for the purpose of retrieving mineral values which are deposited in relatively thin payzones, it is advantageous to be able to penetrate the payzone in a straight line, usually horizontally, or substantially horizontally, thereby exposing a generous area of the payzone to the borehole. Where the payzone may be located a few hundred feet below the surface of the ground, the borehole must deviate from the substantially vertical to a substantially horizontal path of penetration along a very sharp bend having a radius of curvature of the order of tens of feet, instead of a radius of curvature of thousands of feet common in conventional directional drilling.

In my previous patent application, Ser. No. 108,686; filed Dec. 31, 1979; now U.S. Pat. No. 4,333,539; and patent application Ser. No. 360,585; filed Mar. 22, 1982; now U.S. Pat. No. 4,432,423 as a divisional application of patent application, Ser. No. 108,686 to which reference is made for further background of the invention, there is disclosed both method and apparatus for carrying out drilling operations of this type. Reference is also made to the following issued patents which are related to the drilling of curved boreholes, i.e., curved boreholes having a high angle of deviation:

U.S. Pat. No. 2,699,920, Jan. 18, 1955
U.S. Pat. No. 2,708,099, May 10, 1955
U.S. Pat. No. 2,717,146, Sept. 6, 1955
U.S. Pat. No. 2,734,720, Feb. 14, 1956
U.S. Pat. No. 2,743,082, Apr. 24, 1956
U.S. Pat. No. 2,745,634, May 15, 1956
U.S. Pat. No. 2,745,635, May 15, 1956
U.S. Pat. No. 2,804,926, Sept. 3, 1957

A major drawback of the prior art of liquid (drilling mud) operated motors (or positive displacement motors) driving rock drill bit combinations lies in the diameter and length of the assembly being of a size which precludes the circumnavigation of a sharp bend. Consequently, the prior art of liquid operated turbine motors and bit assembly demands that a relatively long bend be made, which is undesirable as contrasted to a deviated hole which commences in a straight nearly vertical line for a few hundred feet in depth, and then abruptly deviates laterally through a high angle of curvature and penetrates the payzone substantially horizontally.

W. Tiraspolsky wrote a work entitled "The Theoretical Approach to Turbodrilling", published in *World Oil*, November and December 1957, in which he shows that downhole liquid operated turbine motors, also called turbodrills, produce power to actuate the shaft which rotates the rock bit with the kinetic energy of the fluid flowing through the motor.

The torque developed by a turbodrill is maximum when the turbodrill stalls. The stall torque $T_o$ is $$T_o = \eta \frac{nw(1-\epsilon)Q^2}{g\lambda\pi b} \tan\beta$$

where $\eta$=Mechanical efficiency
n=Number of turbine stages
w=Fluid density (lb/ft$^3$)
$\epsilon$=Fluid loss coefficient
Q=Fluid flow rate (ft$^3$/sec)
g=Gravitational constant (32.2 ft/sec$^2$)
$\lambda$=Fluid contraction coefficient
b=Rotor vane width (ft)
$\beta$=Exit angle of rotor and stator blades.

The optimal power output of the turbodrill is proportional to the product of the speed N and the output torque T. This equation is $$HP = \frac{2\pi\, NT}{33{,}000}$$

where

N=Rotary speed (rpm)
T=Torque (ft/lb).

The optimal power output is maximum at a speed equal to half the runaway speed as shown in the attached FIG. 1.

The turbodrill power output as a function of turbine rotary speed is shown in FIG. 2 and is given by:

$$N_R = \frac{120\,(1-\epsilon)\,Q}{\lambda(\pi D)^2 b} \tan\beta \text{ (rpm)}$$

where D=the normal rotor vane diameter (ft).

Using the above equations and various fluid flow rates, the length of the turbodrills to produce a nominal 20 HP shaft output are calculated in Table 1.

TABLE 1

| Q'(gal/min) | Q(ft$^3$/sec) | $N_R$ | n | Length (ft) |
|---|---|---|---|---|
| 200 | 0.45 | 262.7 | 1046 | 174.33 |
| 300 | 0.67 | 391.1 | 317 | 52.83 |
| 400 | 0.89 | 519.5 | 135 | 22.50 |

where $\eta$=0.85
w=74.9 lb/ft$^3$ (10 lb/gal)
$\epsilon$=0
$\lambda$=1
b=1/12 ft
$\beta$=45°
D=6/12 ft
Length=2 nb.

In the above, a 7 in. diameter motor has been assumed (i.e., 6 in. diameter turbine blade). Considering the length of the turbine motor section above plus approximately 12 inches for the bit sub and bit, then the minimum radius of curvature of borehole that such a motor could circumnavigate would be the radii given in Table 2.

TABLE 2

| Q'(gal/min) | Length (ft) | ≃ Radius (ft) |
|---|---|---|
| 200 | 174.33 | 26,348.44 |
| 300 | 52.83 | 2,483.06 |
| 400 | 22.50 | 472.70 |

It can be seen that a liquid operated turbodrill with a nominal 20 HP shaft output horsepower will have a length which precludes it from circumnavigating a sharp bend in the borehole, i.e., a bend with a radius of tens of feet.

In contrast, the downhole pneumatic turbine motor, havin a nominal 20 HP shaft output horsepower, will have a length of approximately two feet; this will allow it to circumnavigate a sharp bend in the borehole of a radius of the order of tens of feet.

SUMMARY OF THE INVENTION

This invention relates to drilling of boreholes, and specifically to a pneumatic turbine which turns a rotary bit to achieve a deviated borehole. The pneumatic turbine motor is connected to the lower end of a flexible or articulated drill string. The borehole extends in a straight line downhole a few hundred feet, then abruptly changes direction, and penetrates a payzone substantially horizontally.

The pneumatic turbine is provided with reaction ports at the trailing end thereof which are aligned to force the turbine motor against the bit, thereby forcing the bit to bear against the formation being penetrated and preclude the need for advancing the flexible drill string from the vertical hole by means of the weight of the drill collars at the bottom of the rigid drill string above the flexible drill string. Additionally, the reaction ports may be utilized to overcome reaction torque and to control the direction of drilling.

The pneumatic turbine motor includes a turbine impeller, or rotor, which rotates at a speed of the order of 20,000 rpm. This impeller or rotor drives a first planetary gear reduction assembly. The output of the first planetary gear assembly is connected to drive a second planetary gear reduction assembly, which in turn is connected to drive a third planetary gear reduction assembly. This arrangement of the pneumatic turbine and the tandem connected gear reduction assemblies enables the high speed turbine impeller to extract considerable energy from the expansion of a compressible power fluid, and to utilize the extracted power for slowly turning a relatively large bit with great torque. The desired bit rotation speed is of the order of 100 rpm.

The bit is connected to the output shaft of the third stage planetary reduction gear or final reduction gear assembly. Exhaust gases from the pneumatic turbine motor are conducted longitudinally through the pneumatic turbine motor housing and to the bit where the exhaust gases are used as the drilling fluid at the bit face.

The pneumatic turbine motor is sealed within a chamber, and includes a lubrication system by which all of the moving parts thereof are maintained adequately lubricated. The lubrication is carried out by a unique oil pump system which can provide an oil supply to all gear and bearing units when the system is operated horizontally. The entrances to the oil pump system are located in a freely rotatable unbalanced mechanism which always rotates to keep the entrances in the lowest part of the oil reservoir, particularly while drilling horizontally. Oil recirculated from this pump intake mechanism to the planetary gear system is carried to the remote bearings of the gears via internal oil transport channels.

Accordingly, a primary object of the present invention is a provision of a drill string which includes a compact pneumatic turbine motor and drill bit combination.

Another object of the present invention is to provide a drill string for drilling high angle deviated boreholes comprised of a flexible drill pipe connected to a pneumatic turbine motor which in turn is connected to rotate a drill bit.

A further object of this invention is to disclose and provide a pneumatic turbine motor connected to rotate a drill bit and which includes a pneumatic turbine connected to multiple stages of planetary gear reduction assemblies.

A still further object of this invention is to provide a drill string having a turbine located at the lower end thereof which rotates a drill bit and which is of a size to enable the turbine and drill bit to negotiate a very sharp bend in the borehole.

A further object of this invention is to provide a pneumatic turbine capable of negotiating a high angle deviation borehole and providing sufficient torque to rotate a rock drill bit and force the drill bit into the formation.

A further object of the invention is to provide a reaction port system which can be used to force the bit into the formation, control the direction of drilling, and counter the reactive torque of the bit against the formation.

A further object of this invention is to provide a pneumatic turbine with a lubrication system to lubricate the parts of the system during all angles of a drilling operation.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
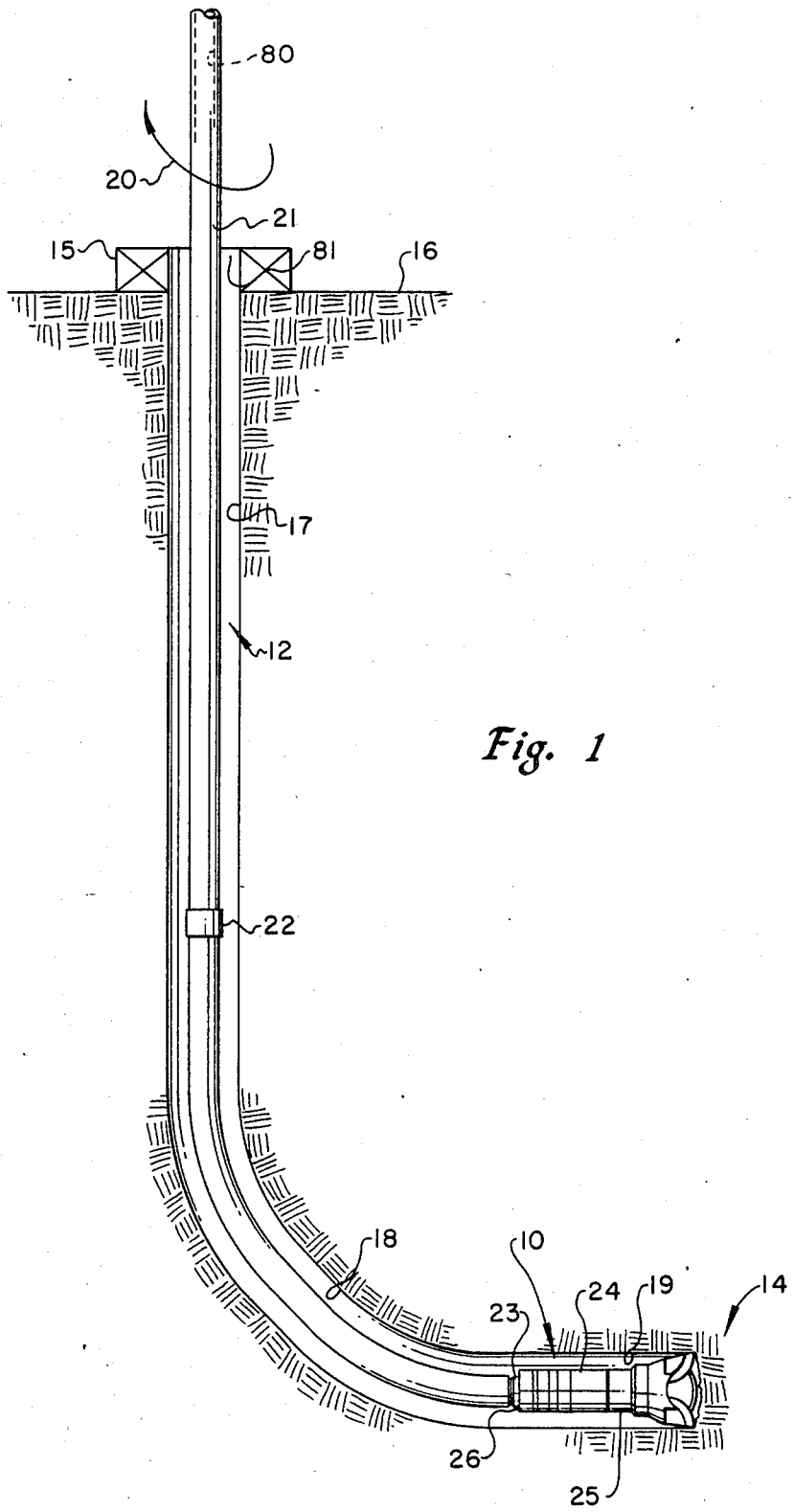
FIG. 1 is a schematical representation of a cross-sectional view of the earth which discloses a borehole having apparatus made in accordance with the present invention associated therewith.

FIG. 1 of the drawings discloses a pneumatic turbine tool 10 made in accordance with the present invention. The turbine tool is located downhole in a borehole 12, and is in the process of penetrating a payzone 14. A wellhead 15, which can take on any number of different forms, is located at the surface 16 of the ground. The borehole 12 includes a first straight segment 17, usually vertical, a curved portion 18, and a second straight segment 19, usually horizontal. A drilling rig, or rotary table, is symbolically indicated by the arrow at numeral 20. Drill pipe 21 extends downhole and can be made up of any number of joints which are connected together as indicated symbolically by numeral 22. The marginal length of the drill pipe located within curved portion 18 of the borehole preferably consists of flexible tubular members as set forth in U.S. Pat. No. 2,717,146, for example.

Figure 2:
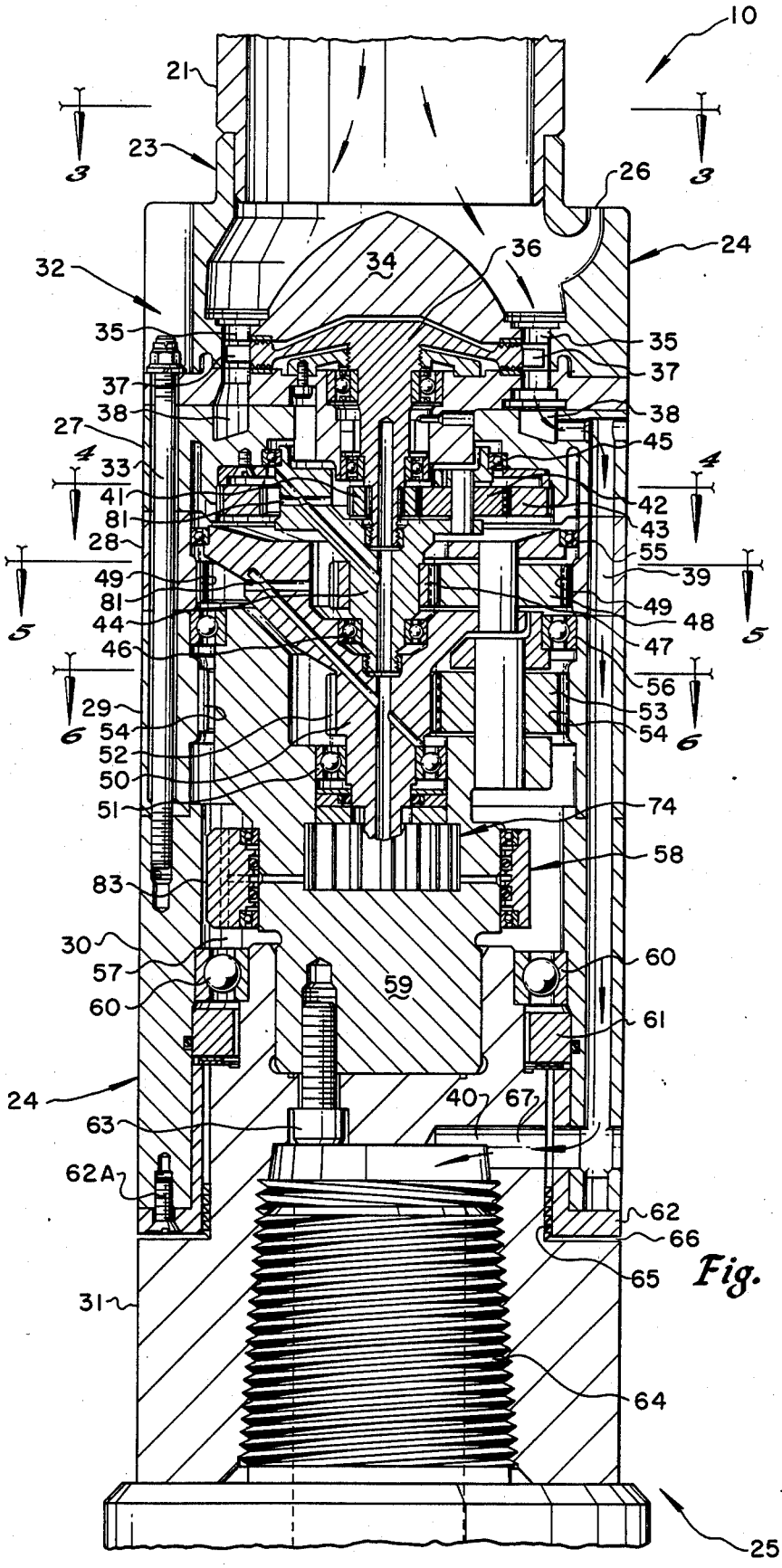
FIG. 2 an enlarged, part cross-sectional view of part of the apparatus disclosed in FIG. 1.

In FIGS. 1 and 2, together with other figures of the drawings, the turbine is disclosed as having a trailing end sub 23, a main body 24, and a forward or leading end sub 25 to which a rock drill bit may be removably affixed. Numeral 26, shown in FIGS. 2 and 3, broadly indicates a reaction port means by which the turbine is forced towards the formation, thereby forcing the drill bit to engage the formation. The openings of these ports may be systematically adjusted to control drilling direction. Reaction port means 26 may also be advantageously used to counteract the turbine torque.

In FIG. 2, together with the remaining figures of the drawings, the main body 24 of the turbine tool 10 is made up of housing sections 27, 28, 29, and 30. Bit sub 31 is rotatably supported at the forward or leading end 25 of the main body of pneumatic turbine 10 and rotates respective to the main body 24 sections 27, 28, 29, and 30, thereby rotating a drill bit which may be removably attached thereto.

Figure 3:
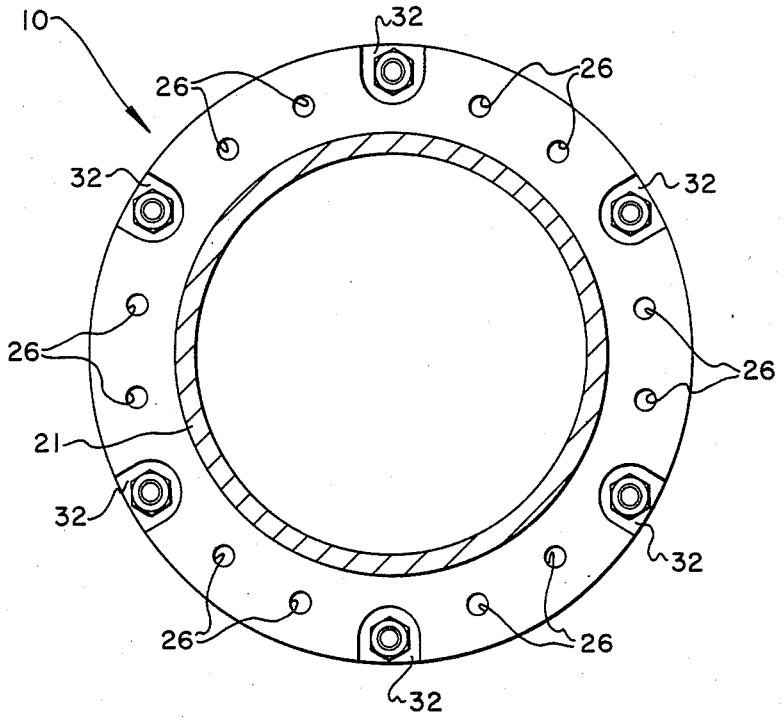
FIGS. 3, 4, 5, and 6, respectively, are cross-sectional views taken along lines 3—3, 4—4, 5—5, and 6—6, respectively of FIG. 2.

Housing sections 27, 28, 29, and 30 of main body 24 include radially spaced apart bolt passageways 32, as shown in FIGS. 2 and 3. Each passageway receives a bolt 33 therethrough and maintains the housing sections 27, 28, 29, and 30 connected together in assembled relationship. Within the illustrated trailing end sub 23, there is located a streamlined vane 34 which guides the compressible power fluid flowing into pneumatic turbine 10 from drill pipe 21. The flow is directed towards radially spaced turbine inlet ports 35. A turbine shaft 36 supports a turbine impeller 37, with the impeller being located within an annular chamber or stator, and arranged to extract energy from the flowing power fluid.

Exhaust chamber 38 is connected to exhaust passageway 39 which directs the flow of the turbine exhaust gases longitudinally through the main body 24 of the turbine tool 10, and into exhaust annulus 40 which opens into bit sub 31 for exit of the exhaust gases through a drill bit when the device is in operation, as will be more fully described hereinafter.

Figure 4:
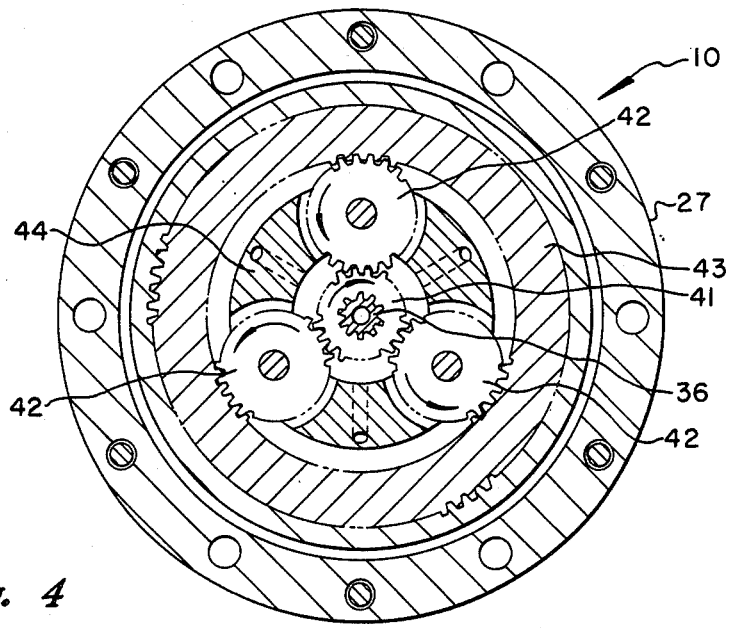

The turbine shaft 36 is attached to and drives a central gear 41 of a first planetary reduction gear assembly. Planetary gears 42 are caged in the usual manner and are meshed with a ring gear 43, thereby driving an output shaft 44 of the first stage at reduced revolutions per minute respective to the speed of the turbine shaft 36. The engagement and direction of rotation of the first planetary gear assembly is shown in FIG. 4. Spaced bearings 45 and 46 maintain the first planetary reduction gear assembly properly supported in aligned relationship within the main housing.

Figure 5:
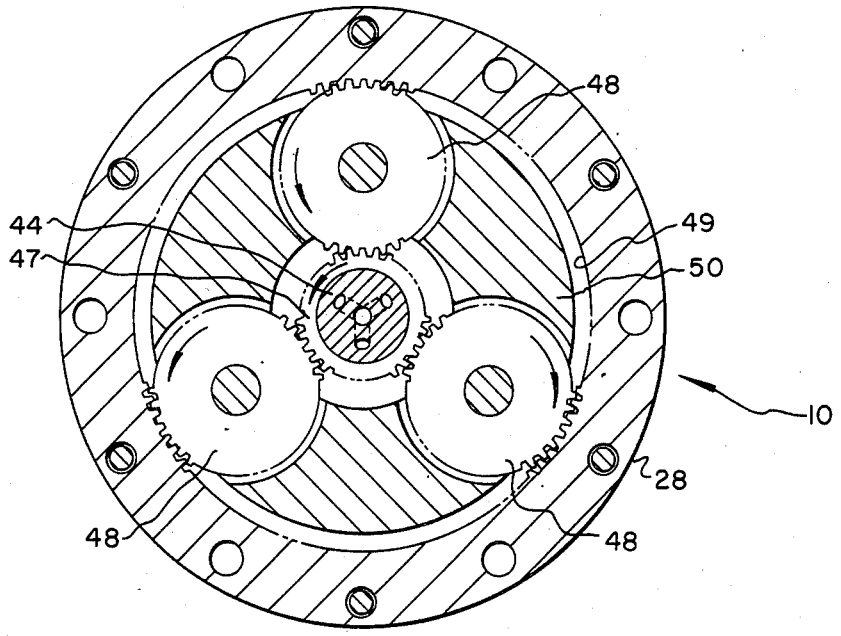

The output shaft 44 includes a central gear 47 affixed thereto which forms part of the second planetary gear reduction assembly. Planetary gears 48 are meshed with central gear 47 and ring gear 49 and thereby rotate output shaft 50 at a reduced speed respective to output shaft 44, which becomes the input shaft for the second gear reduction assembly. FIG. 5 shows the engagement of gears and direction of rotation of the second planetary gear assembly. Bearings 46, 51, and 55 suitably support the second planetary gear reduction assembly.

Figure 6:
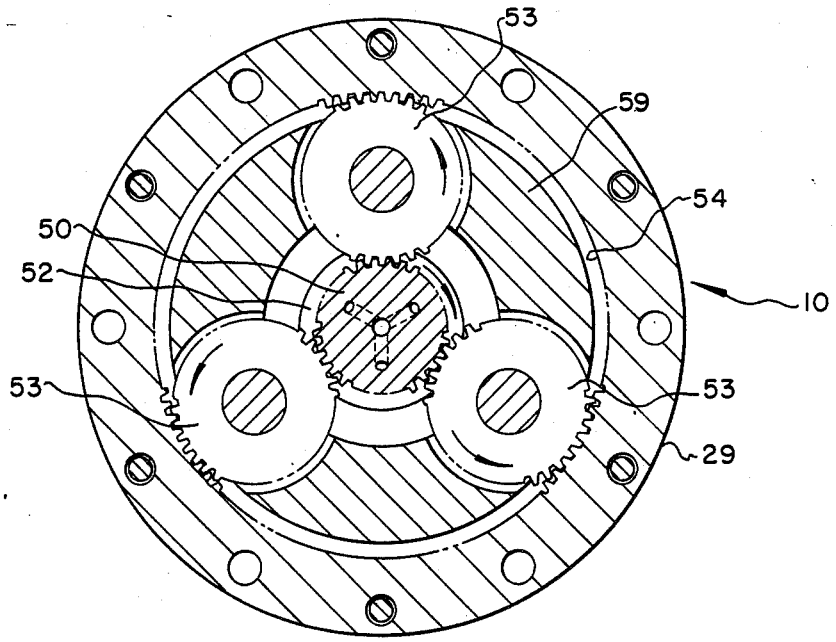

The central gear 52 is affixed to and is rotated by the output shaft 50; and, is meshed with planetary gears 53, which in turn are meshed with a ring gear 54 supported within housing section 29, thereby driving another output shaft 59 at a reduced speed respective to the shaft 50 thereof. FIG. 6 shows the engagement of gears and direction of rotation of the second planetary gear assembly. Journals 55 and 56 are suitably supported within housing sections 28 and 29 respectively. Oil sump reservoir 57 collects and stores lubricant for an oil pickup ring 58. The oil pickup ring is unbalanced in such a manner as to allow it to freely rotate under the action of gravity forces which ensures that the entrances to the oil pickup ring are always located in the lowest portion of the oil sump reservoir 57. The lubricant distribution system will be more particularly described hereinafter. The marginal outer end 59 of the output shaft of the third planetary gear reduction assembly preferably is a splined connection made to fit sub 31, and is received within a complementary configured female cavity formed within the bit sub 31.

Bit sub 31 includes a main bit bearing 60 which resists thrust and radial loads. Seal 61 prevents loss of oil from the reservoir 57 and prevents the ingress of drilling fluid into the interior of turbine tool 10. A wear bushing 62 is removably affixed to housing member 30 by means of the illustrated screws 62A. Bolt 63 maintains the sub 31 from moving laterally respective to the splined connection of the output shaft 59.

Numeral 64 indicates a box, or threaded female connection, which receives the pin, or male threaded connection, of the drill bit. A labyrinth seal 65 reduces leakage through the passageway 66 formed between the wear bushing and the drill bit sub. Flow passageway 67 extends into the central passageway of the bit (not shown) and conducts the flow of compressible fluid to the bit face to thereby provide drilling fluid for the bit cutting surfaces.

Figure 7:
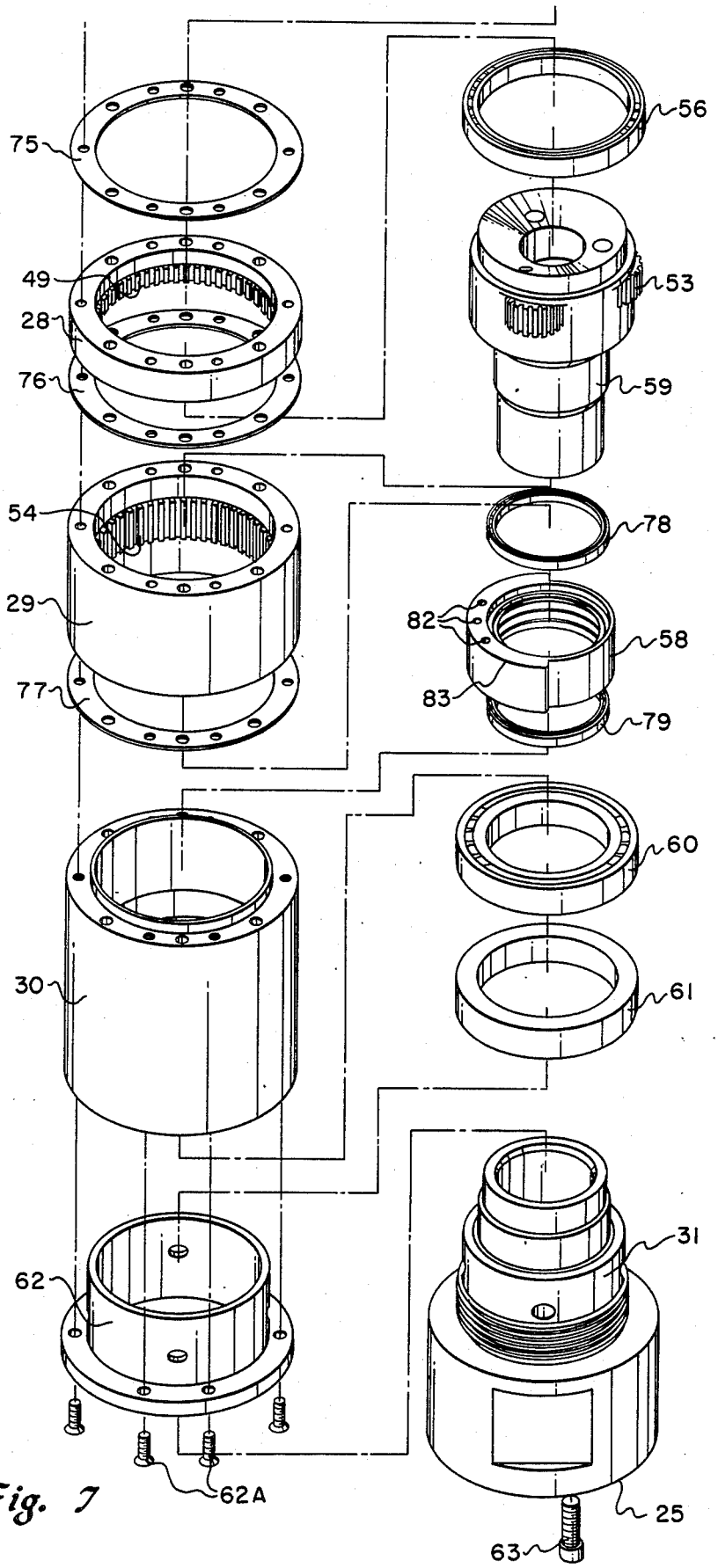
FIGS. 7 and 8 are exploded views of the apparatus disclosed in FIG. 2.
Figure 8:
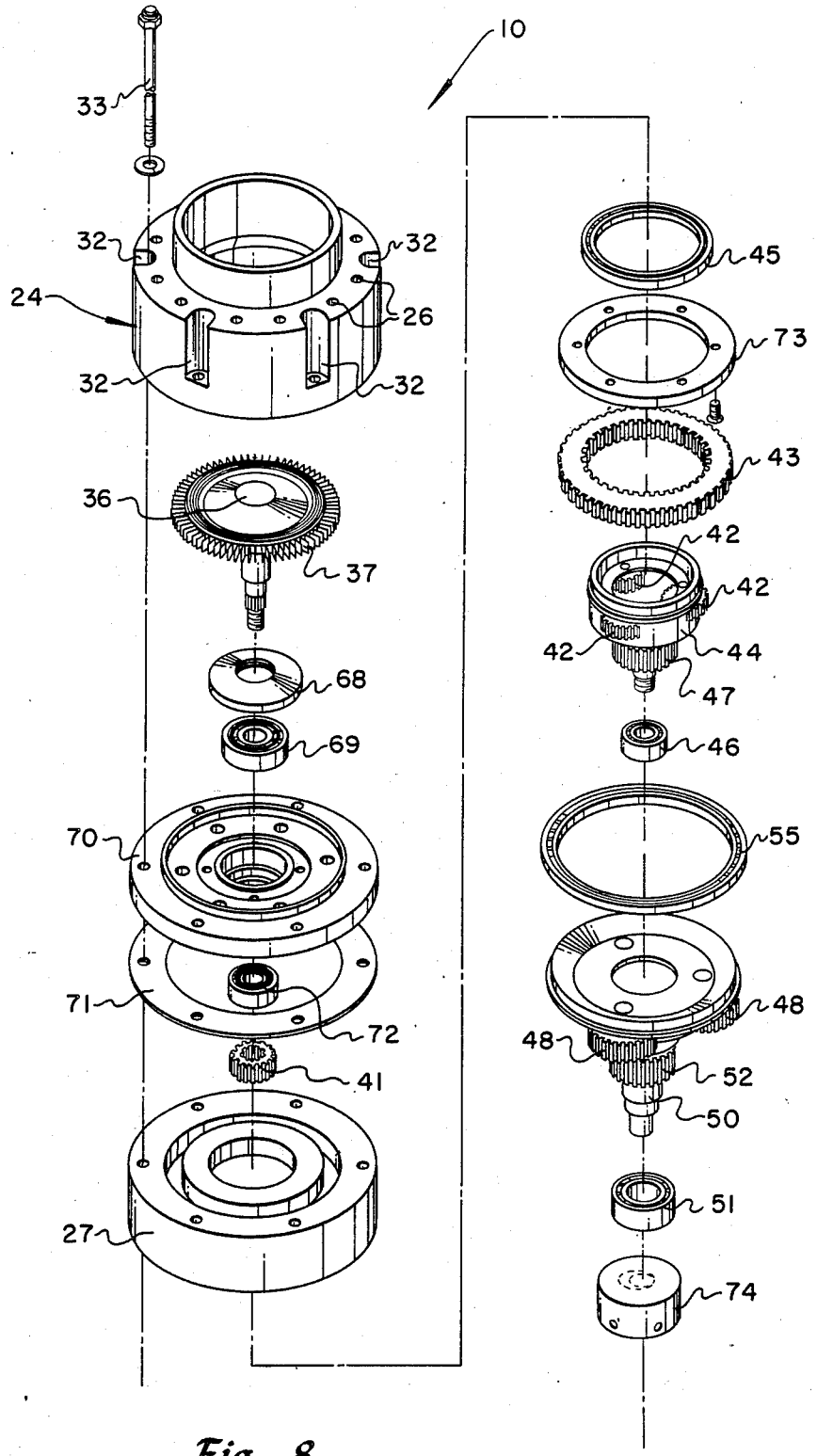

In the exploded view set forth in FIGS. 7 and 8, and referring first to FIG. 8, a guide 68 and bearing 69 is employed to suitably mount the impeller shaft within the main housing. Support 70 is fitted with a gasket 71 and is captured in bolted relationship between the inlet sub and housing section 27. Bearing 72 is carried by support 70. Retainer 73 receives the ring gear 43 adjacent thereto with the first gear reduction assembly being received therethrough.

Oil pump 74 is rotated by shaft 50, as seen illustrated in FIG. 2, for example. Gaskets 75, 76, 77 are interposed between the various housing sections, with bearings 78 and 79 carrying the oil pickup ring 58 in properly oriented relationship respective to the shaft end 59.

Oil pump 74 distributes lubricant to various moving parts of the pneumatic turbine tool 10. Oil, or other suitable lubricant is stored within oil reservoir 57 for pickup by the oil pump 74 so that the oil can be subsequently distributed to the various predetermined moving parts through the distribution passages 81 which are machined within the turbine.

Lubricant which has been returned to the leading or forward end of turbine tool 10 is collected within the oil reservoir 57. Oil pickup ring 58 includes oil ports 82 as shown in FIG. 7. Oil ports 82 are suitably machined within the heavier side 83 of oil pickup ring 58. Oil pickup ring 58 is machined so that one side 83 is heavier than the other. The heavier side 83 is thus urged by gravity to the lower side of housing section 30 when turbine tool 10 is in a substantially horizontal position so as to be submerged below the surface to therefore collect lubricant which accumulates within the lower portion of reservoir 57 due to gravitational forces. Lubricant is then picked up and delivered into oil ports 82 by the action of the oil pump 74 and distributed through the illustrated distribution passages 81.

In operation, a standard drill bit, which can take on any number of different forms, is threadedly secured to the bit sub 31. A flexible drill pipe is connected to the inlet sub of the turbine tool and the assembly is run downhole on the end of a drill string. Drilling fluid such as air is supplied at approximately 80 psi and flows downhole into the turbine ports 35, whereupon energy is extracted by the turbine as the shaft 36 thereof is rotated at extremely high velocity.

This action rotates the planetary gear shaft 44, which turns planetary gear 48 and rotates shaft 50 at a reduced speed respective to shaft 44. Shaft 50 rotates gear 53, thereby rotating the splined shaft end 59 at a reduced speed respective to shaft 50. The splined shaft 59 imparts rotational motion into the drill bit sub 31.

The reaction ports 26 provide a turning force or torque in opposition to the reaction of the drill bit, and further forces the bit towards the formation. It is considered within the comprehension of this invention to systematically adjust the relative position of the reaction ports 26 to control the direction of drilling. The spent turbine gas flows through the exhaust passageways 39, 40, 67, and into the central passageway of the drill bit, where the spent compressible fluid acts as a drilling fluid. The drilling fluid returns the cuttings uphole as indicated by numeral 81 of FIG. 1.

The oil pickup ring provides the oil pump with a source of lubricant. The lubricant is forced to flow along the various indicated passageways, thereby lubricating the various coacting moving parts of the turbine tool.

Figure 9:
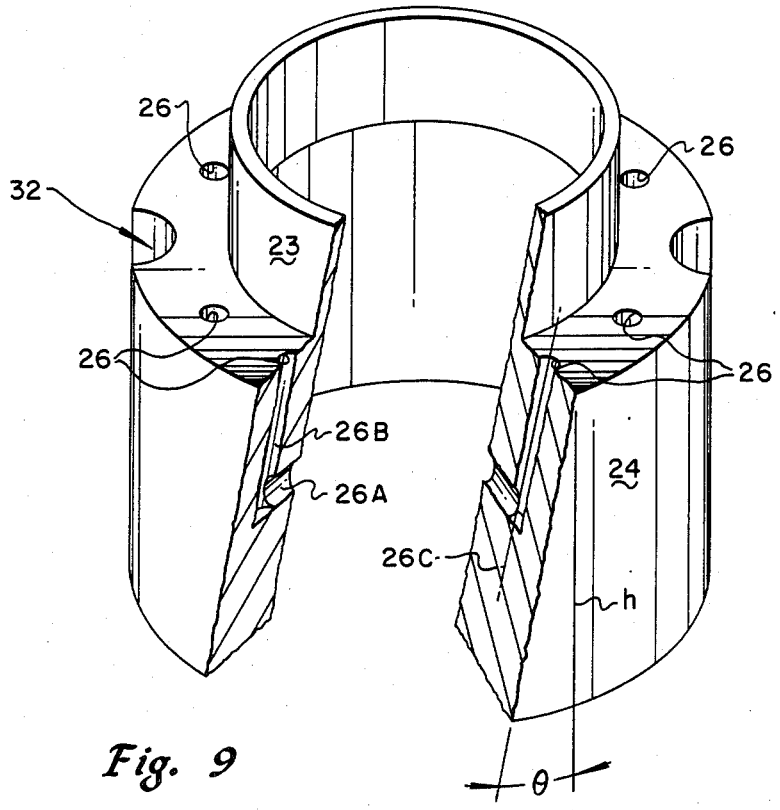
FIG. 9 is a detailed, perspective view of part of the apparatus disclosed in foregoing figures, with some parts being removed therefrom and some of the remaining parts being shown in cross-section.

FIG. 9 shows the details of the reaction ports 26 of which 8 ports are provided in this specific embodiment of the invention. The reaction ports will vent additional air flow not passing through the turbine motor out of these ports 26 in mainly a rearward direction. However, the ports will be slightly angled as noted at $\theta$, in their rearward direction to a direction opposite to that of the motor's internal torque. If the bit turns to the right (as seen from above), there will be a lefthand countertorque applied to the motor housing. Therefore, the reaction ports will have a slight angulation (from exact rearward) to left (as viewed from above). Therefore, the total rearward force, placing the force on the bit, will be:

$$F_b = \frac{G}{g} V \cos\theta$$

and the countertorque to the motor will be:

$$T_c = \frac{G}{g} V R_p \sin\theta$$

$G$ = *the total weight rate of flow through the 8 reaction ports (lb/sec)*

$G$ = the total weight rate of flow through the 8 reaction ports (lb/sec)

$V$ = the velocity of flow of the air flow as it leaves the ports to the annulus (ft/sec)

$g$ = the acceleration of gravity (32.2 ft/sec$^2$)

$\theta$ = the slight angle from rearward of the reaction ports (degrees)

$R_p$ = the radius to the reaction ports (ft).

The power produced by the reaction turbine can then be determined by:

$$P = T\omega$$

where $T$ = defined torque $\omega$ = angular velocity of output shaft (50) with respect to output shaft (59).

In FIG. 9, numeral 26A indicates a lateral passageway which intersects angled passageway 26B. Numeral 26C is the longitudinal axis of the passgeway 26B. The angle $\theta$ is formed between the longitudinal axis of the passageway 26B and the line h which is parallel to the longitudinal central axis of the turbine.

Figure 12:
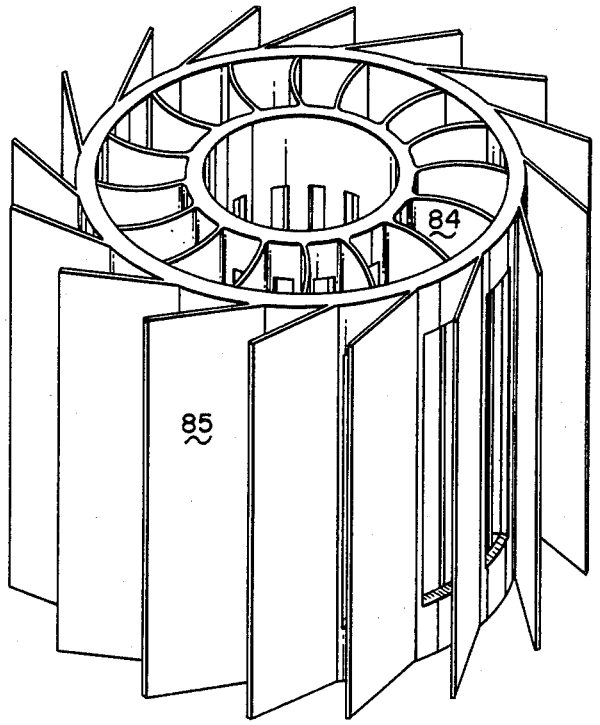
Figure 10:
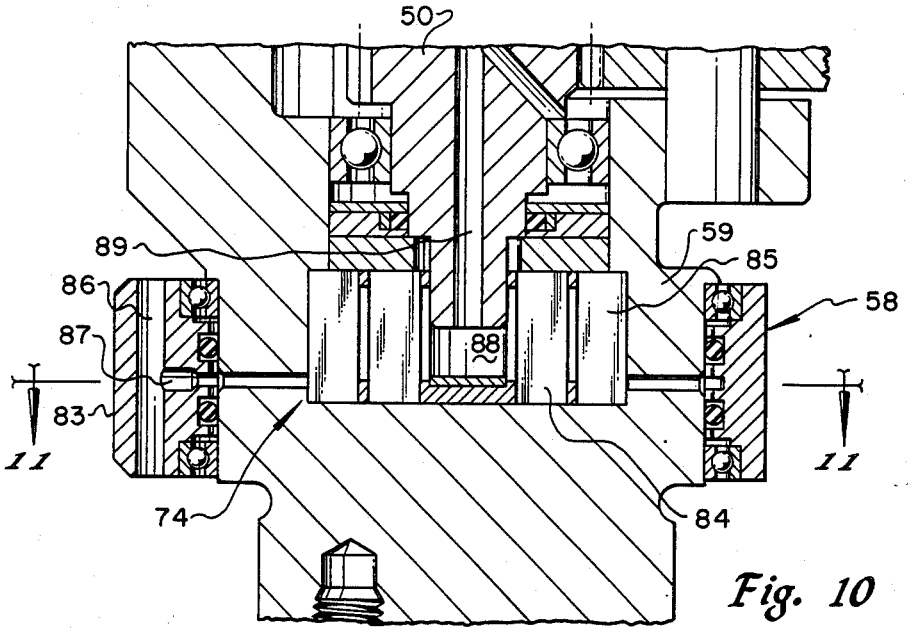
FIG. 10 is a fragmentary longitudinal, cross-sectional detailed view of part of FIG. 2.
Figure 11:
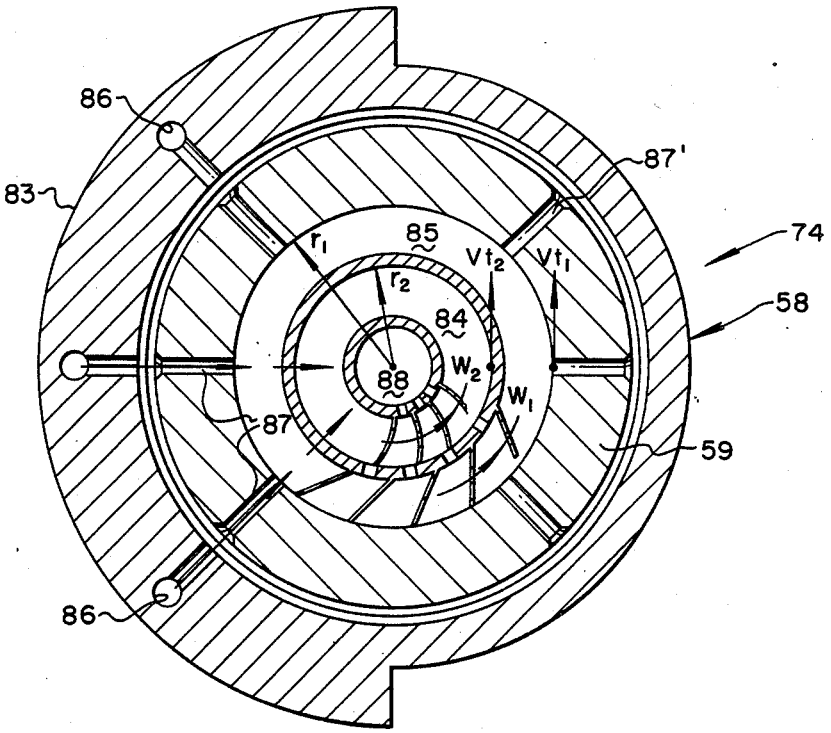
FIG. 11 is a cross-sectional view taken along line 11—11 of FIG. 10; and, FIG. 12 is an enlarged, perspective view of part of the apparatus disclosed in FIG. 2.

In FIGS. 10–12, the inner vanes 84 of oil pump 74 are connected to be rotated by shaft 50 of FIG. 2. The outer vanes 85 are connected to be rotated by shaft 59 of FIG. 2. Oil passageway 86 of FIG. 11 always is in communication with oil sump reservoir 57 of FIG. 2, and with passageway 87, which feed vanes 85 with a low pressure oil supply. Central chamber 88 contains high pressure oil for oil passageway 89 of FIG. 2. Members 58 and 59 jointly cover the passageways 87' which may be located above the oil level within reservoir 57.

FIG. 12 illustrates further details of the oil pump. The oil pump system will permit oil contained in the oil sump reservoir to be drawn through the appropriate ports in the reaction turbine housing and the two vane systems 84, 85 to the central output shaft, shown as 50 in FIG. 2, where the oil will then be distributed to various moving parts of the pneumatic turbine tool.

With reference to FIG. 10, the outer vane system 85 is rotated by output shaft 59, while the inner vane system 84 is rotated by output shaft 50. Since the inner vane system 84 is rotating at a higher velocity than the outer vane system 85, a torque is exerted on the fluid (oil) which gives it a tangential velocity component. The fluid then passes through the inner vane system through which the tangential velocity decreases, producing a torque according to the equation:

$$T = Q\rho V_{t1} r_1 - V_{t2} r_2$$

where $Q$ = flow rate of fluid (ft$^3$/sec)

$\rho$ = density of fluid (slugs/ft$^3$)

$V_{t1}$ = tangential velocity at inlet to inner vane system (ft/sec)

$V_{t2}$ = tangential velocity at outlet of inner vane system (ft/sec)

$r_1$ = radius to inlet of inner vane system (ft)

$r_2$ = radius to outlet of inner vane system (ft).

I claim:

1. In a borehole forming operation wherein a rotary drill bit forms a borehole which extends along a relatively straight line and then makes a turn of a very small radius of curvature and then extends along another relatively straight line as the borehole penetrates a pay-zone, the method of drilling said borehole comprising the steps of:

(1) flowing power fluid down a flexible drill pipe string; said flexible drill pipe string has the capability of negotiating said turn of very small radius while concurrently conducting said power fluid therethrough;

(2) attaching a turbine motor having an output shaft to the end of said drill pipe string, and using the power fluid for driving the output shaft of the turbine;

(3) series connecting a plurality of planetary reduction gear assemblies together and to the output shaft of the turbine; said gear assemblies having input and output shafts; and, arranging the input and output shafts of the reduction gear assemblies along a common axial centerline;

(4) enclosing the planetary reduction gear assemblies within a housing which includes an oil chamber, circulating oil from said oil chamber, to said planetary reduction gear assemblies, and back to said oil chamber to thereby provide a closed lubrication system for said planetary reduction gear assemblies;

(5) carrying out step (4) by placing an oil pick-up ring about an oil pump; forming a plurality of radial passageways from the pump outwardly into communication with the oil pick-up ring; making one side of the oil pick-up ring heavier respective to another side of the ring so that the heavy side of the ring gravitates into the oil located within the oil chamber, thereby providing the suction side of the oil pump with an oil supply, regardless of the orientation of the housing;

(6) turning a rotary drill bit with the output shaft of the last of the series connected reduction gear assemblies;

(7) using the spent power fluid from the turbine for drilling fluid by conducting the spent power fluid from the turbine, through a passageway formed externally of the reduction gear assemblies and to the bit; and, (8) overcoming the torque of the bit while forcing the bit towards the formation by directing a flow of power fluid through a reaction port which is arranged in opposition to the direction of penetration of the drill bit, and at an angle to provide a force which is in opposition to the drill bit torque.

2. In a borehole forming operation wherein a rotary drill bit forms a borehole which extends along a relatively straight line and then makes a turn of a very small radius of curvature and then extends along another relatively straight line as the borehole penetrates a payzone, the method of drilling said borehole comprising the steps of:

(1) flowing power fluid through a flexible drill pipe string; said flexible drill pipe string has the capability of negotiating said very small radius of turn while concurrently conducting said power fluid therethrough;

(2) attaching a turbine motor having an output shaft to the end of said drill pipe string, and using the power fluid for driving the turbine;

(3) series connecting a plurality of planetary reduction gear assemblies together by connecting an output shaft of one gear assembly to an input shaft of another gear assembly and connecting a first of the gear assemblies to the output shaft of the turbine motor; arranging the input and output shafts of the reduction gear assemblies along a common axial centerline;

(4) turning a rotary drill bit with the output shaft of the last of the series connected reduction gear assemblies;

(5) enclosing the planetary reduction gear assemblies within a housing which includes an oil chamber, circulating oil from said oil chamber, to said planetary reduction gear assemblies, and back to said oil chamber to thereby provide a closed lubrication system for said planetary reduction gear assemblies;

(6) carrying out step (5) by placing an oil pick-up ring about an oil pump; forming a plurality of radial passageways from the pump outwardly into communication with the oil pick-up ring; making one side of the oil pick-up ring heavier respective to another side of the ring so that the heavy side of the ring gravitates into the oil located within the oil chamber, thereby providing the suction side of the oil pump with an oil supply, regardless of the orientation of the housing.

3. In a borehole forming operation, wherein the borehole must extend along a relatively line and then make an abrupt turn before continuing along another straight line which continues on through a payzone, and wherein a relatively flexible drill pipe string is connected to a gas turbine motor for turning a rotary drill bit, the improvement comprising:

a housing, means mounting the gas turbine motor at one end of the housing, means connecting an output shaft to said gas turbine motor axially aligned with said housing;

a plurality of planetary reduction gear stages enclosed within said housing, each of said reduction gear stages including an input shaft and an output shaft, said input and output shafts of each of the said reduction gear stages being aligned along a common axis, the output shaft of the turbine motor being connected to the input shaft of the first stage reduction gear, the output shaft of the first stage reduction gear being connected to the input shaft of the second stage reduction gear;

said housing including means forming an oil chamber therewithin; and means for circulating oil from said oil chamber, to said planetary reduction gear stages, and back to said oil chamber;

said means for circulating oil includes an oil pump, an oil pick-up ring received about said oil pump, a plurality of radial passageways formed from the pump, outwardly into communication with the oil ring, means by which one side of the oil pick-up ring is made heavier respective to another side of the ring so that the heavy side of the ring gravitates into the oil located within the oil chamber, thereby providing the suction side of the oil pump with an oil supply, regardless of the orientation of the housing;

means connecting a bit sub to the output shaft of the last stage reduction gear; and, means supporting the bit sub from the end of the housing which is opposed to the turbine motor;

a reaction port means aligned respective to the housing and to the turbine motor to receive power fluid therethrough and exhaust the power fluid into the borehole annulus to thereby react against bit torque while forcing the bit sub towards the formation;

a passageway formed from the turbine motor, through said housing, and about the gear reduction stages, and into the bit sub to thereby enable the spent power fluid to be used as drilling fluid.

* * * * *